US005980405A

United States Patent [19]

Hertel

[11] Patent Number: 5,980,405

[45] Date of Patent: Nov. 9, 1999

[54] ITEM OF GAMES AND SPORT EQUIPMENT

[76] Inventor: Reinhard Hertel, Rollbaumsberg 7, Hambergen, D-27729, Germany

[21] Appl. No.: 08/860,675

[22] PCT Filed: Oct. 13, 1996

[86] PCT No.: PCT/EP96/04457

§ 371 Date: Aug. 12, 1997

§ 102(e) Date: Aug. 12, 1997

[87] PCT Pub. No.: WO97/14477

PCT Pub. Date: Apr. 24, 1997

[30] Foreign Application Priority Data

Oct. 16, 1995 [DE] Germany ..... 295 16 278 U

[51] Int. Cl.[6] ..... A63B 43/02

[52] U.S. Cl. ..... 473/576; 473/429

[58] Field of Search ..... 473/575, 576, 473/570, 423–430, 471; 273/DIG. 26

[56] References Cited

U.S. PATENT DOCUMENTS

| | | | |
|---|---|---|---|
| 3,165,315 | 1/1965 | Petrusek | 473/576 |
| 3,498,613 | 3/1970 | Dreyer | 473/575 |
| 3,655,190 | 4/1972 | Lemon | 473/576 |
| 3,936,051 | 2/1976 | Walker, Jr. | 473/576 |
| 4,222,563 | 9/1980 | Heftler et al. | 273/DIG. 26 |
| 4,479,649 | 10/1984 | Newcomb et al. | 473/570 |
| 5,094,462 | 3/1992 | Boyle et al. | 473/576 |
| 5,199,715 | 4/1993 | May | 473/576 |
| 5,467,981 | 11/1995 | Rudell et al. | 473/576 |

*Primary Examiner*—Steven Wong

[57] ABSTRACT

The invention relates to an item of games and sport equipment in which an rebounding body (1), preferably a ball, is connected to a variable-length distancing or pull cord (2), is guided by way-of a sliding and deviating member (6), and is provided with a handle region (8). By pivoting a swing-providing device the rebounding body orbits and the direction of the rebounding body is reversed by the rebounding effect. The radius of the trajectory of the rebounding body is altered by guiding (pulling or loosening) of the distancing or pull cord. The direction of the trajectory is caused by changing the movement of the swing-providing device.

19 Claims, 10 Drawing Sheets

ITEM OF GAMES AND SPORT EQUIPMENT

BACKGROUND OF THE INVENTION

This invention relates to game and sport equipment.

Game and sport equipments are known in a big variety. Ball games of different kinds are very popular.

For most of the ball games more or less space requirments are necessary.

Because of insufficient space and due to the traffic density ball games in the city are almost impossible so that playful and sporting activities with balls are often done inadequate.

OBJECT AND SUMMARY OF THE INVENTION

Therefore the object of the invention is to create a game and sport equipment, which gives the user the opportunity for playful and sporting activities on small space without endangering themselves or others.

In the following one possible embodiment will be described.

The present invention proposes a game and sport equipment comprising an resilient, preferably ballshaped rebounding body, which is connected through a distancing or pull cord to a holder, which in turn is mounted to a swing-providing device, e.g. a foot, in a manner that the distancing or pull cord is guided in a deviating and sliding member, e.g. a ring, an eyelet, or a channel, which is positioned at said holder, or is attached to said sliding member.

The distancing or pull cord, which is fixed to the rebounding body and is guided through the sliding member has a grip or retaining region at its other end. The sliding element can be fixed directly to a shoe or can be present at a shoe itself, e.g. at the sole or upper area of the shoe.

The present invention provides a new game and sport equipment, which offers the player many new and interesting game variations and takes into account the actual "play-value" of a jumping ball, but prevents uncontrolled jumping or rolling away.

By skilful pivoting the foot at start of the game the ball is brought from one side of the foot over the vertex to the other side of the foot.

With the right swing the distancing or pull cord is tightened by the centrifugal force of said rebounding body so that the rebounding body moves in an orbit or an approximate orbit. By the resilience of the rebounding body the direction of the rebounding body is reversed at every impact. By guiding (distancing or pulling) of said distancing or pull cord the radius of the orbit is altered respectively.

By skilful moving the body and skilful guiding (pulling and distancing) of said distancing or pull cord many variations of the game are possible which are making more or less demands to the skill, the sporting activity, and the condition of the player according to the intensity of the game.

There are many variations to play: e.g. playing in front, beside or behind the body. Skilful evading and/or changing the trajectory in connection with changing the length of the distancing cord results in always new game combinations.

It is intended to provide the distancing or pull cord with a retaining region or a handle, which provides the opportunity to roll up or down the distancing or pull cord. This can also be done automatically, e.g. with a winding roller, which is fixed in or at the handle and which is biased with a drilled rubber, and is rolled off by effect of the centrifugal force of the rebounding body during playing.

A further possible embodiment is e.g. that a stick, a pod, or a pipe is used as an swing-providing device at which the distancing or pull cord is fixed or guided through.

The game and sport equipment can also be formed in a manner, which allows to be played by two players concurrently.

Here the rebounding body is provided on both sides with a distancing or pull cord. The rebounding body can be attached in a fixed or sliding manner. Both of the ends are fixed to the swing-providing device—foot, bar, pipe, or similar. Here the attraction is in the harmony of the activities of both players.

For the extension of the playing and sporting capabilities, there can be added to the game target discs, which has to be hit with the rebounding body during playing.

These target discs can have acoustical and/or optical and/or adhering properties, e.g. such that upon impact of the rebounding body the target disc adhere to the rebounding body or a sound is generated. The target object can also be formed as an selfadhesive tail.

In a further possible embodiment the rebounding body itself outputs acoustical signals or has a light source.

A further embodiment is to provide the game and sport equipment with a counter. The counting pulses can be transmitted to the counter mechanically or contactless, e.g. by movement of the rebounding body or by movement of the pull cord.

The fastening of the rebounding body at the distancing or pull cord can be that way, that the rebounding body has a fastening groove and can be hold by an outer loop, formed of the distancing or pull cord, or the rebounding body is connected to the distancing or pull cord by an internal or external fastening, or the rebounding body can be inside a netlike grating, which is connected to the distancing or pull cord.

DESCRIPTION OF THE PREFERRED EMBODIMENTS

Figure 1:
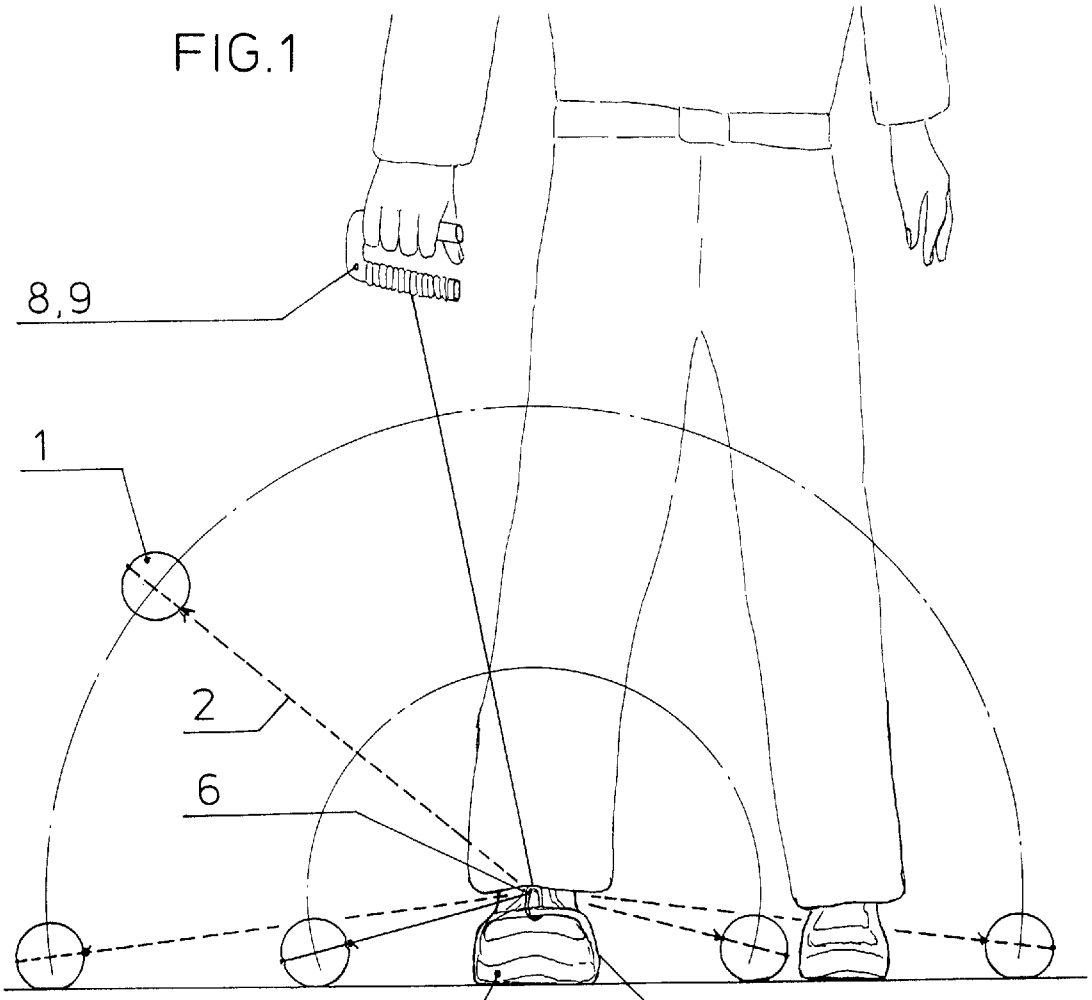
FIG. 1 shows a front view of a first embodiment of the sport equipment according to the invention mounted on a player's foot.

FIG. 1 shows schematically the playing action of a possible embodiment of the game and sport equipment according to the invention. Here a rebounding body (1) is fixed at a distancing or pull cord (2), which is guided through a sliding and deviating member (6).

At the upper end of the distancing or pull cord (2) a handle (8, 9) with a winding-up-apparatus is attached.

The sliding and deviating member (6) is fixed at the holder (4).

The holder itself in turn is fixed to the swing-providing device (3), in this case at the shoe, or at the foot.

The rebounding body at the outer radius is in use on an orbit above the foot and its direction is reversed by impact.

The player can vary the distance between the rebounding body (1) and the sliding and deviating member (6) by pulling the distancing or pull cord (2).

Figure 2:
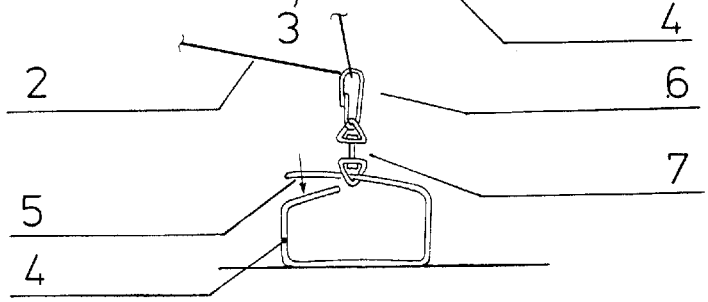
FIG. 2 shows a detailed front view of a holder for a sliding member.

FIG. 2 shows a possible adjustable holder (4) having a fastener, preferably a hook-pile fastener, for fastening at the shoe or directly at the foot.

The holder (4) has a whirl (7), which has a latterally open sliding and deviating member (6), where the distancing or pull cord (2) is guided through.

Figure 3:
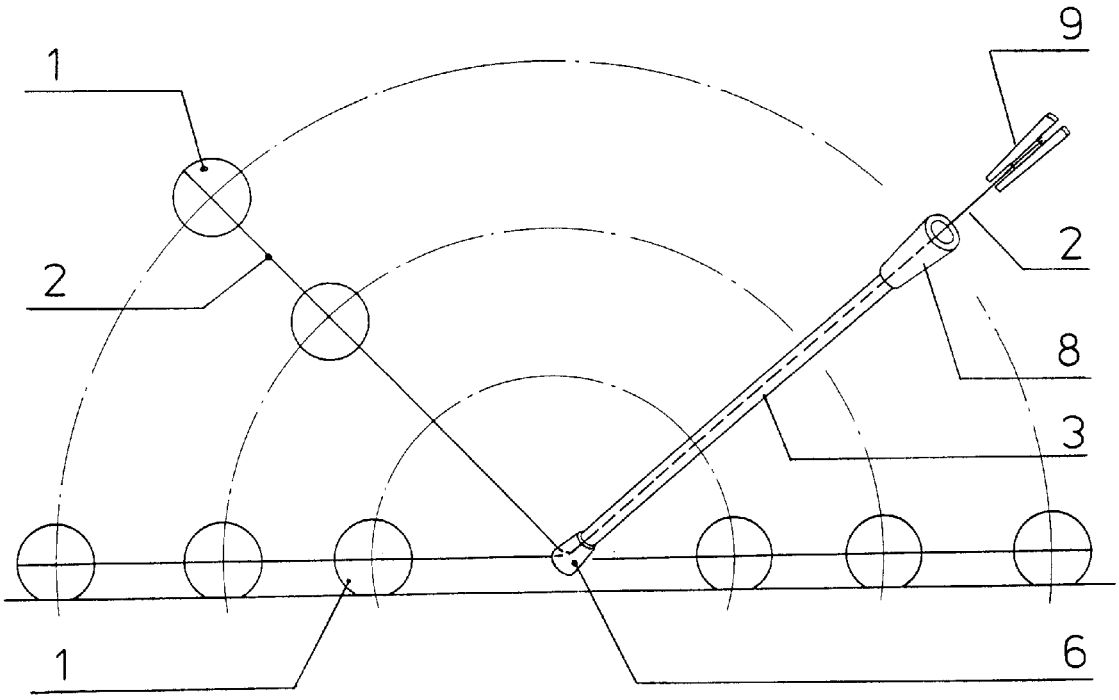
FIG. 3 shows a top view of a second embodiment of the sport equipment according to the invention.

FIG. 3 shows a possible variation of the embodiment of the game and sport equipment in playing operation. Here a hollow bar with a handle (8) as a holder (4) and swing-providing member (3) is depicted.

The distancing or pull cord (2) is guided through this bar and concurrently swing-providing member (3).

At one end of the distancing or pull cord (2) the rebounding body (1) and at the other end a winding up and down apparatus (9) are shown. The swing-providing member (3) is moved by hand.

The different radiuses are showing the rebounding body (1) at different, trajectories by shortened or elongated distancing or pull cord (2).

Figure 4:
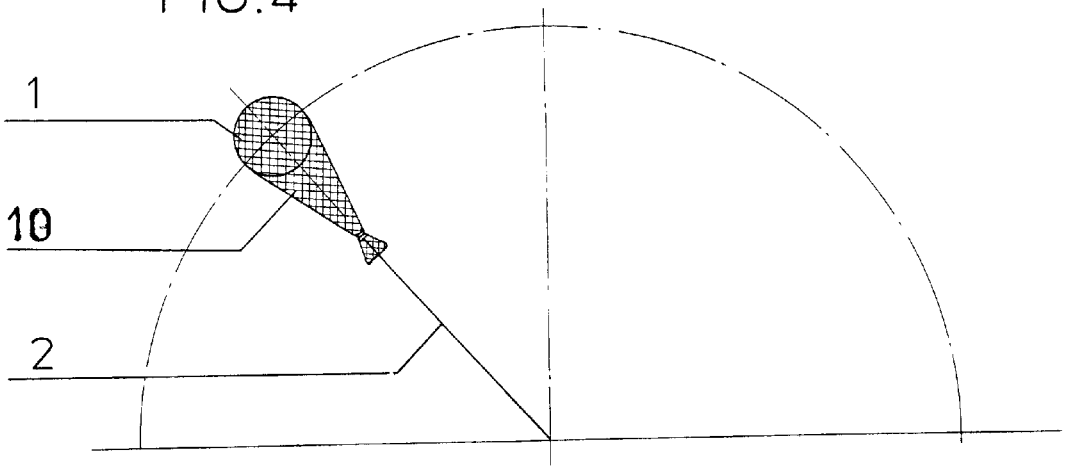
FIG. 4 shows a detailed front view of a rebounding member.

FIG. 4 shows on its trajectory a rebounding body (1), comprising an ordinary ball, e.g. a tennis ball, in a netlike member (10), which is connected with the distancing or pull cord (2).

Figure 5:
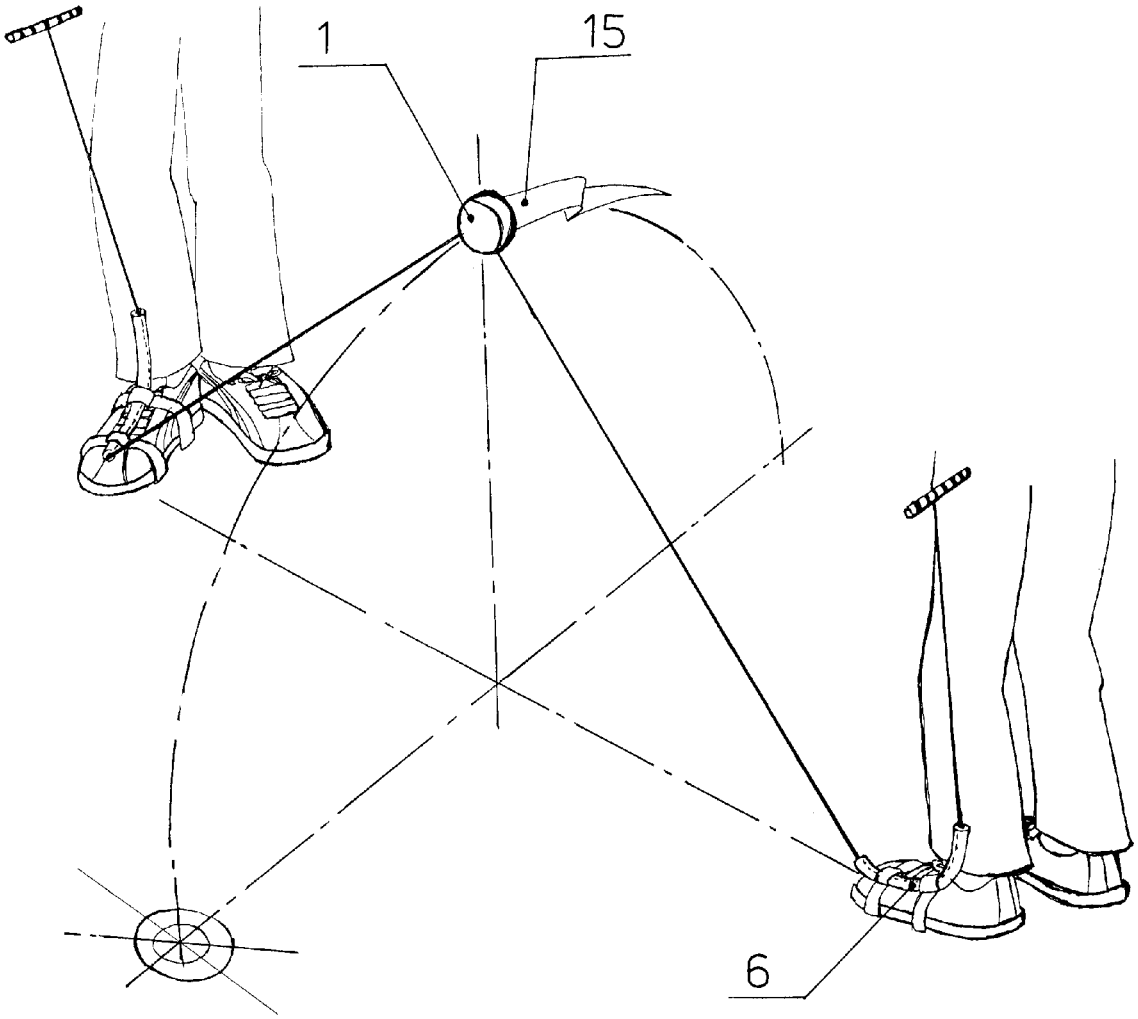
FIG. 5 shows a side view of a third embodiment of the sport equipment according to the invention mounted on feet of two players, accordingly.

FIG. 5 shows a possible embodiment of the game and sport equipment for two players. The rebounding body (1) is provided with a tail (15), which is connected either fixed or detachable to the rebounding body. A second distancing or pull cord is alternatively attachable to the rebounding body (1).

The distancing or pull cords are respectively guided in a sliding and deviating member (6) and will be operated by hand.

Figure 6:
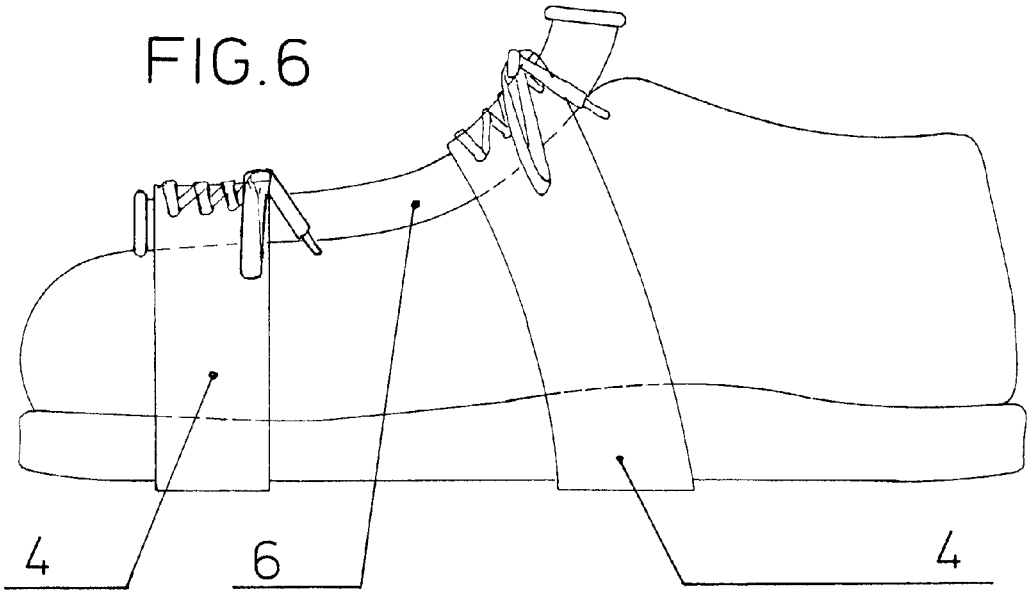
FIG. 6 shows a detailed side view of a modified sliding member.
Figure 7:
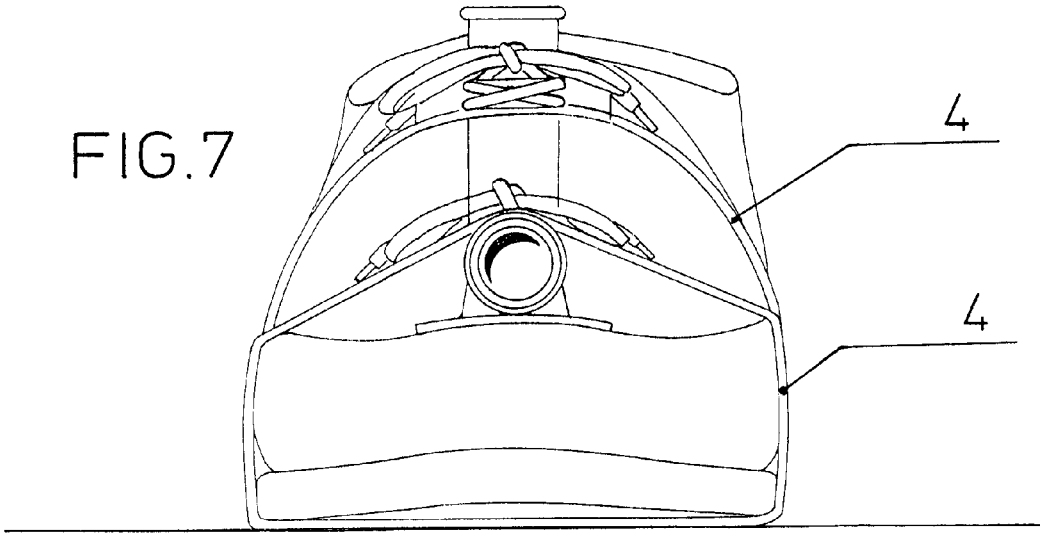
FIG. 7 shows a detailed front view of the sliding member according to FIG. 6.

FIGS. 6+7 show a sliding and deviating member (6), formed as an elongated hollow body, which is detachable attached to a shoe by an double-holder (4), or is fixed to the shoe.

The elongated sliding and deviation member (6) has at its ends a thickening of the material, to withstand the friction of the distancing or pull cord, which is guided movable through the hollow body (6).

Figure 8:
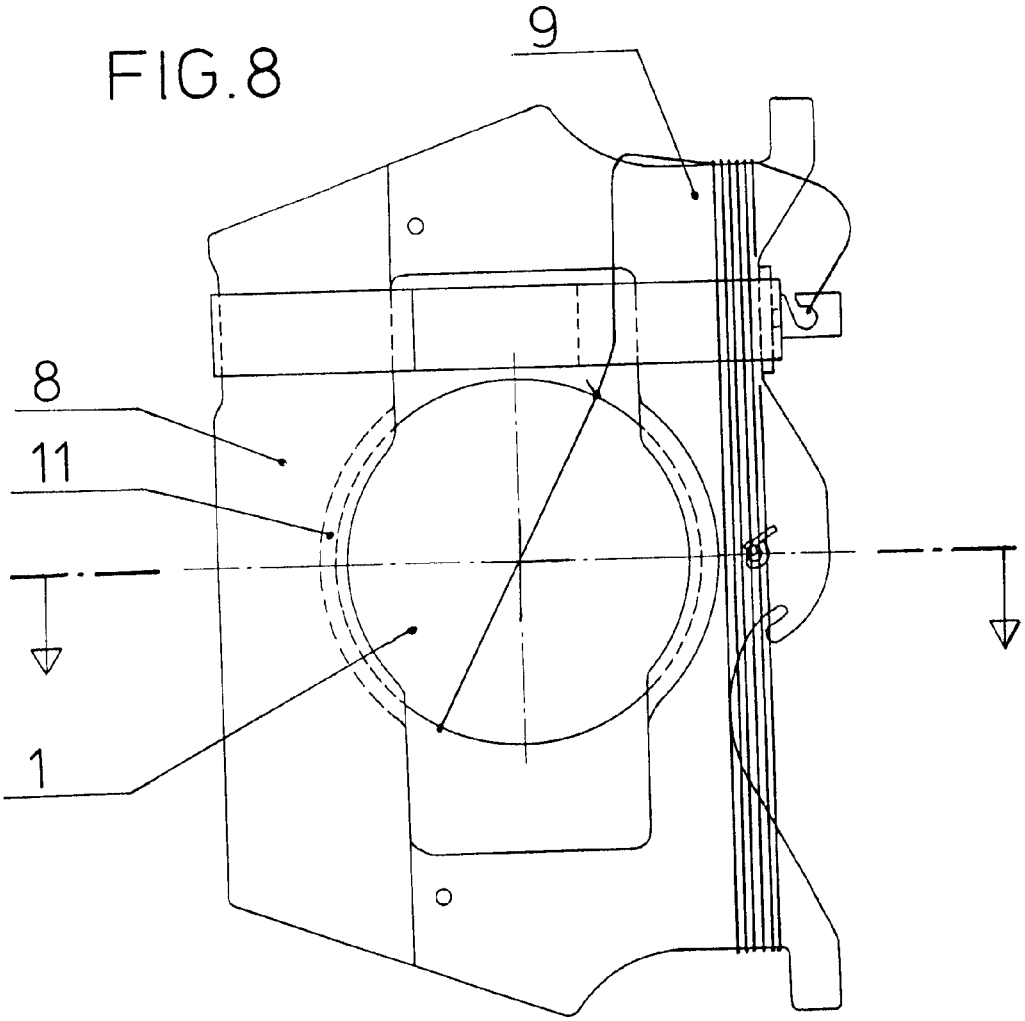
FIG. 8 shows a detailed side view of a handle for the rebounding body and the pull cord.

FIG. 8 shows a possible embodiment of a holder (11) for the rebounding body (1) and for the distancing or pull cord (2).

The rebounding body (1) is pressed respectively clamped into the holder. The distancing or pull cord (2) is winded up and can be fixed at any distance. The holder (4) will be tensed to the cord holder (9) after winding up the distancing or pull cord (not illustrated).

Figure 9:
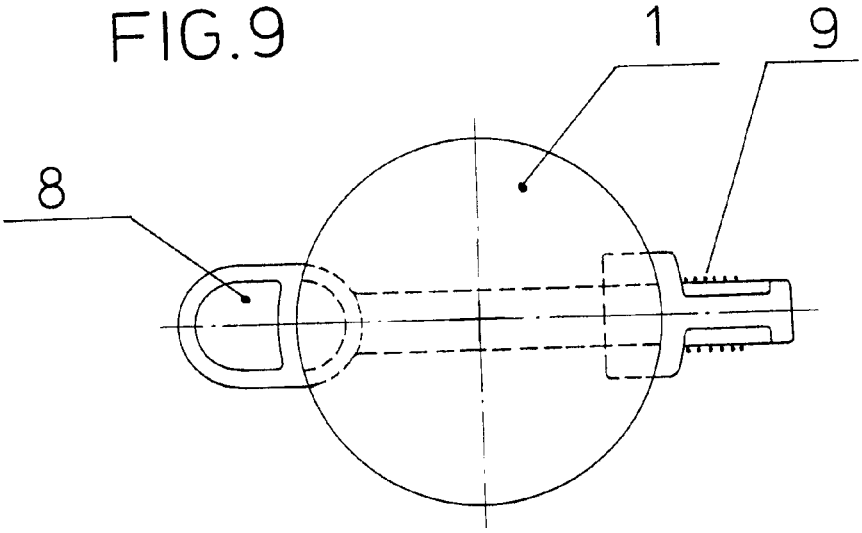
FIG. 9 shows a sectional view of FIG. 8.

FIG. 9 shows a sectional view of FIG. 8.

Figure 10:
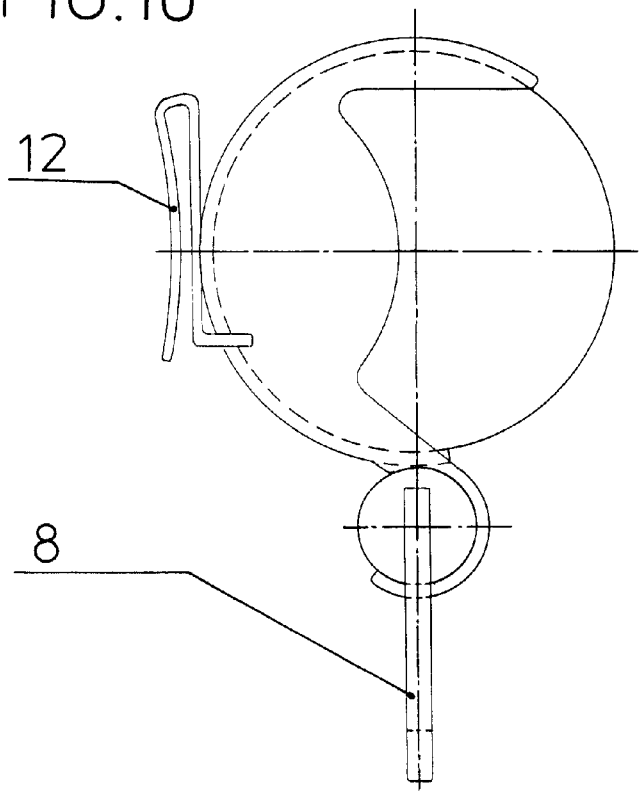
FIG. 10 shows a sectional view of a further embodiment of the holder for the rebounding body and the pull cord.

FIG. 10 shows a sectional view of a further embodiment of a holder (11), which accomodates the rebounding body (1) and the holder (9) of the pull cord (2). The holder (11) has a fixing member (12), which can be hung in e.g. a belt.

Figure 11:
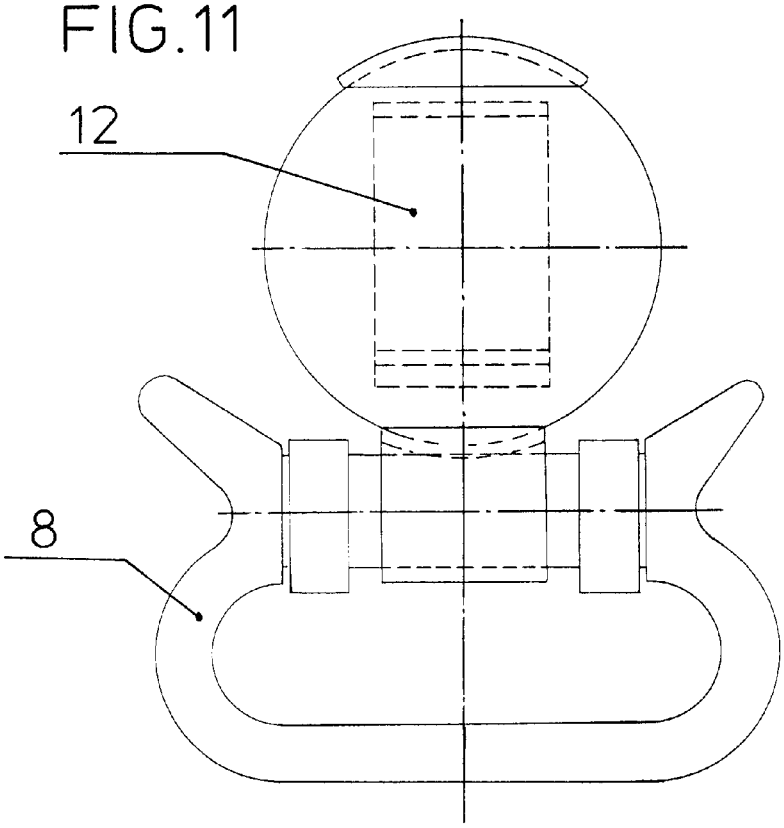
FIG. 11 shows a cross section of the holder according to FIG. 10.

FIG. 11 shows FIG. 10, but turned by 90 degrees.

Figure 12:
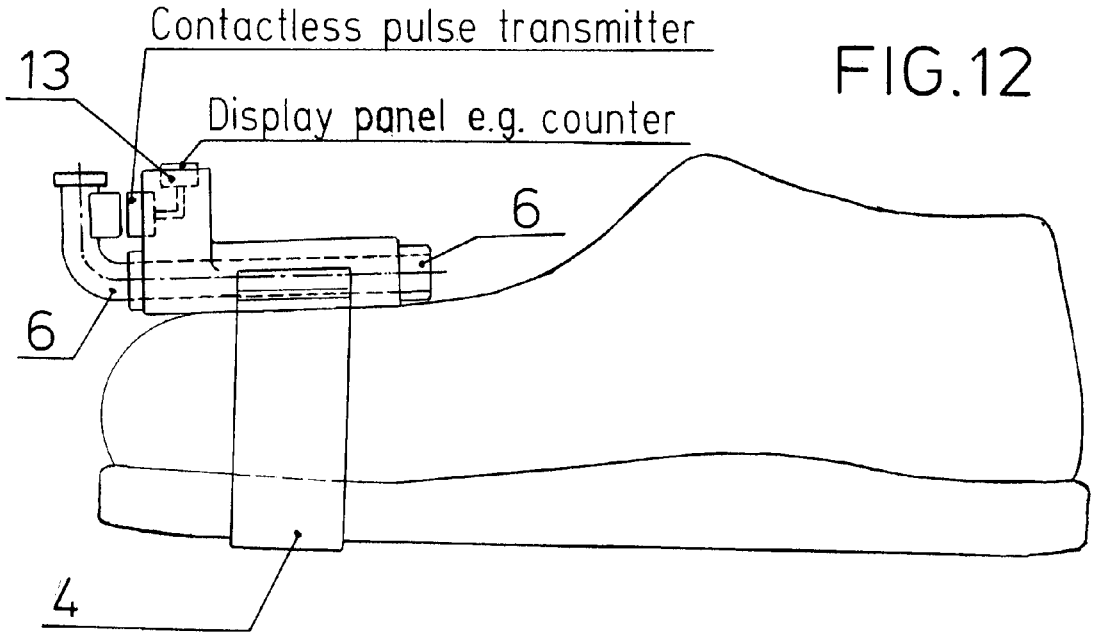
FIG. 12 shows a side view of a further embodiment of the sliding member.

FIG. 12 shows in a side view a schematically depiction of a possible embodiment of the game and sport equipment including a counter (13), which registers the number of swinging movements.

Figure 13:
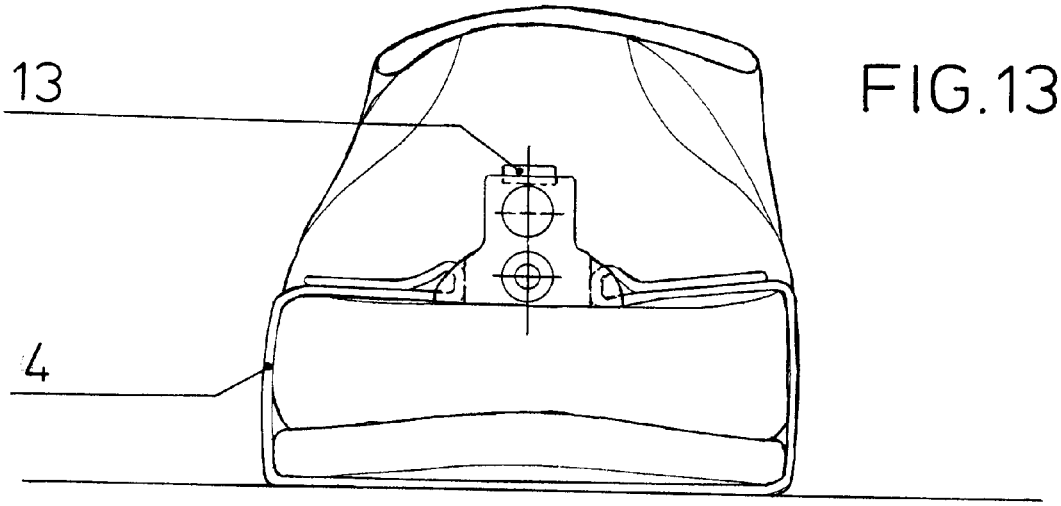
FIG. 13 shows a front view of the sliding member according to FIG. 12.

FIG. 13 shows an elevational view of FIG. 12.

Figure 14:
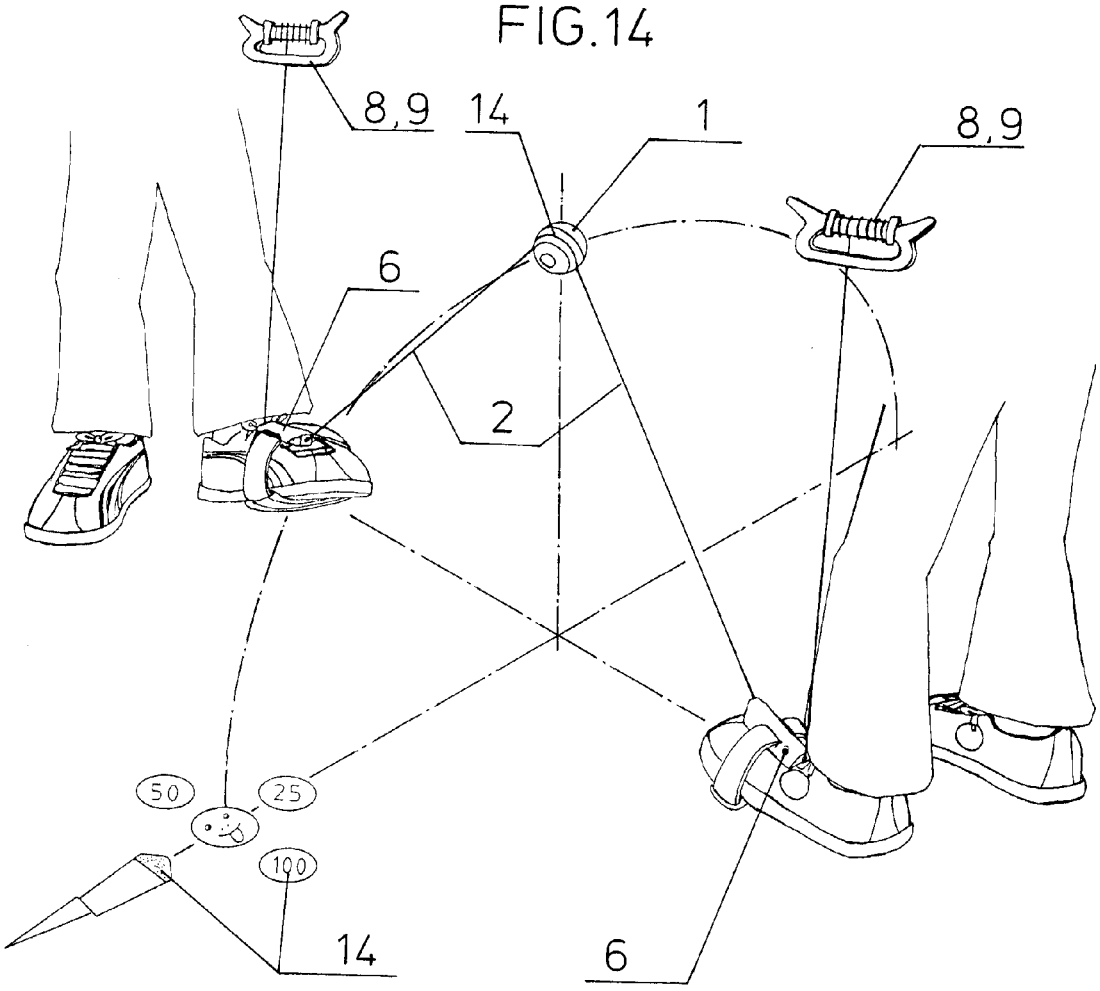
FIG. 14 shows a side view of a further embodiment of the sports equipment for two players.
Figure 15:
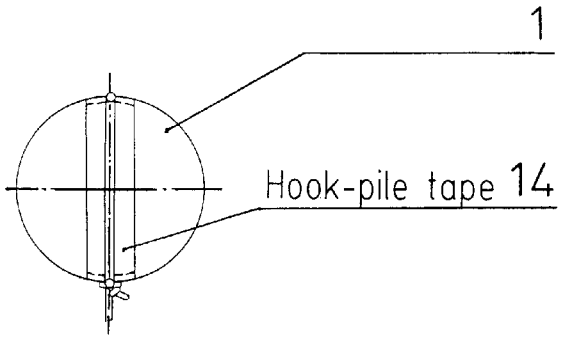
FIGS. 15 to 19 show possible embodiments of the rebounding body.
Figure 16:
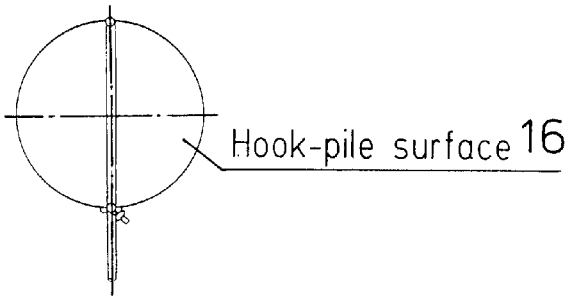
Figure 17:
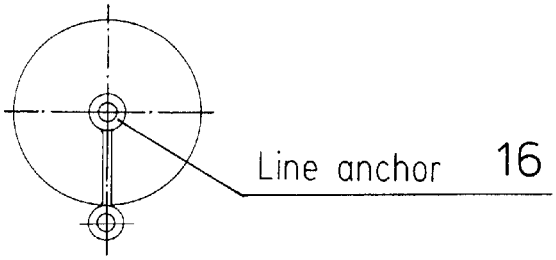
Figure 18:
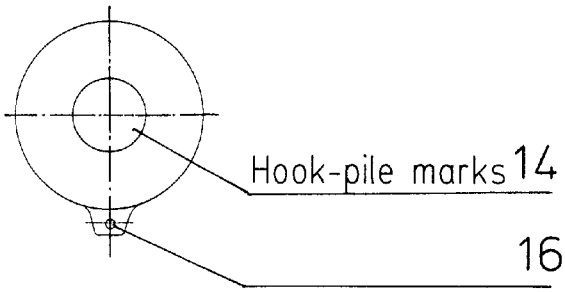
Figure 19:
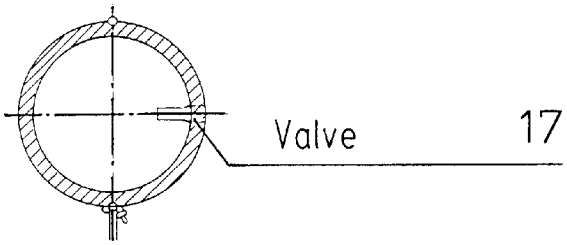

FIG. 14 shows a possible embodiment of the game and sport equipment for concurrent use by two players.

The rebounding body (1) is provided with two distancing or pull cords, which will be each operated through a sliding and deviating member (6), which is fixed at the shoe. The rebounding body (1) has hook-pile and adhesive elements, which are connecting with the adhesive elements on the ground upon impact.

FIGS. 15–19 shows some possible embodiment features of the ballshaped rebounding body or by rebounding body of other shapes.

Figure 20:
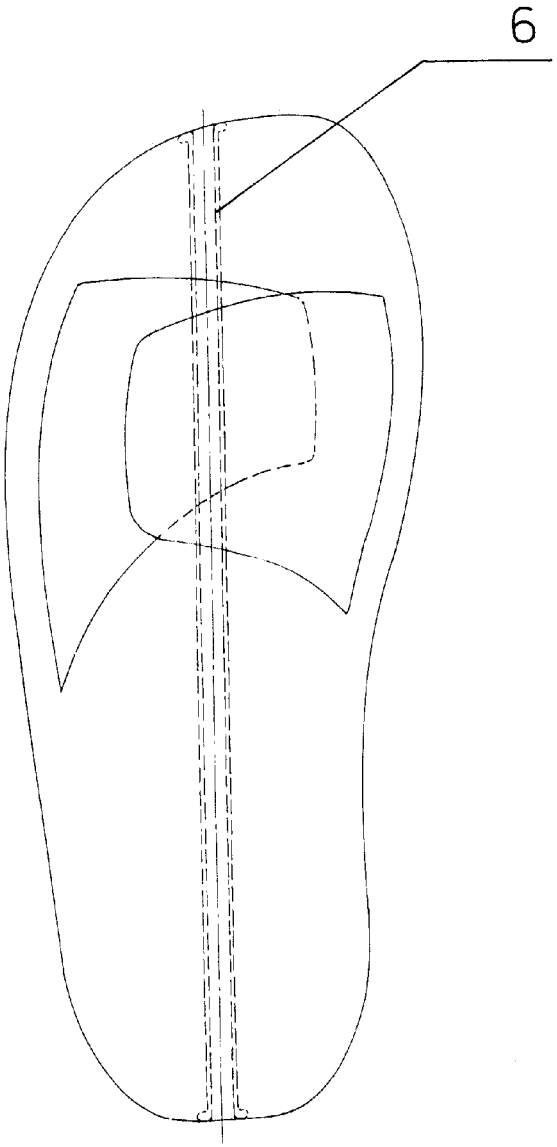
FIG. 20 shows a bottom view of a shoe having a another embodiment of the sliding member.
Figure 21:
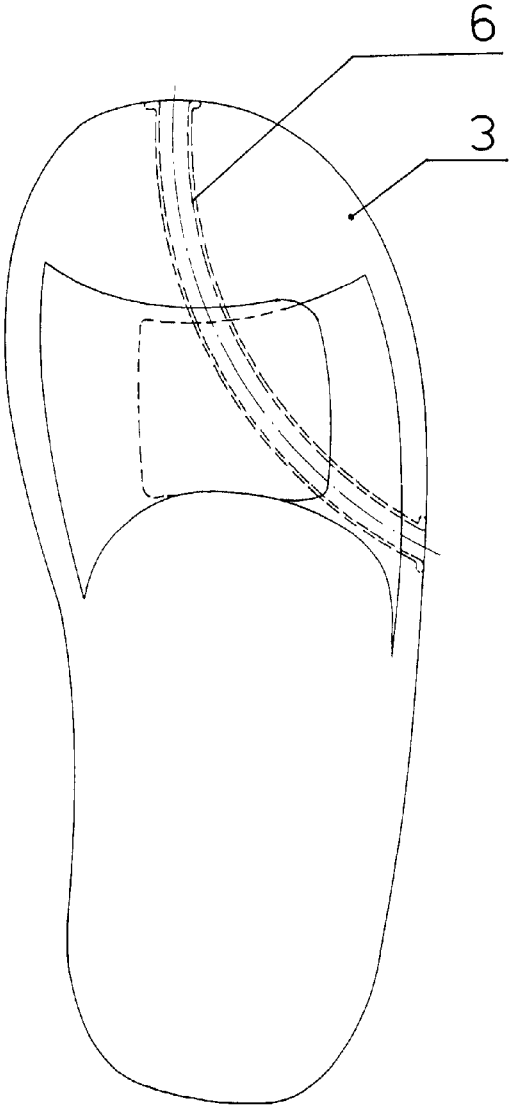
FIG. 21 shows a bottom view of a shoe having a further embodiment of the sliding member.

FIGS. 20–21 shows each in schematically representation a shoe, by which at the sole region a sliding and deviating member (6) formed as elongated hollow body extends below the foot of the player, so that the distancing or pull cord moves under the users foot.

Reference Numbers

| No. | Description |
|---|---|
| 1) | rebounding body |
| 2) | distancing or pull cord |
| 3) | swing-providing device |
| 4) | holder |
| 5) | fastener for the holder |
| 6) | sliding and deviating member |
| 7) | whirl |
| 8) | handle or grip zone |
| 9) | receptacle for the cord |
| 10) | net member |
| 11) | holder for the rebounding body |
| 12) | fastening member |
| 13) | counter |
| 14) | hook-pile elements/hook-pile surface |
| 15) | tail |
| 16) | fixture in the rebounding body/at the rebounding body |
| 17) | valve |

I claim:

1. A game and sport equipment comprising a rebounding body;

a pull cord attached to said rebounding body;

a first sliding member, a first handle, and a first holder, whereby said pull cord runs from said rebounding body through said first sliding member to said first handle, said first handle being remotely arranged in respect to said first sliding member, said first sliding member being connected to said first holder, said first holder being separately carried out from said first handle, and the distance between said first handle and said first sliding member being variable.

2. The game and sport equipment of claim 1 wherein said first holder being attachable to an extremity of a first human being.

3. The game and sport equipment of claim 2 wherein said first holder being attachable to said first human being's foot.

4. The game and sport equipment of claim 1 wherein said pull cord is of a low-stretching material.

5. The game and sport equipment of claim 1 wherein said first handle is provided with a winding-up apparatus for winding up said pull cord.

6. The game and sport equipment of claim 1 wherein said pull cord running from said first handle through said first sliding member to said rebounding body is extended and further runs through a second sliding member provided with a second holder to a second handle.

7. The game and sport equipment of claim 6 wherein said rebounding body being slidable connected to said pull cord.

8. The game and sport equipment of claim 6 wherein said second holder being attachable to an extremity of a second human being.

9. The game and sport equipment of claim 7 wherein said second holder being attachable to said second human being's foot.

10. The game and sport equipment of claim 1 further comprising at least one target.

11. The game and sport equipment of claim 10 wherein said at least one target is provided with a signal-device, which generates an acoustical signal upon impact of said rebounding body.

12. The game and sport equipment of claim 10 wherein said rebounding body is provided with a signal-device, which generates an acoustical signal upon a hit on said target.

13. The game and sport equipment of claim 10 wherein said rebounding body being provided with a first adhesive element, and said target being provided with a second corresponding adhesive element.

14. The game and sport equipment of claim 1 wherein said rebounding body being self-illuminating.

15. The game and sport equipment of claim 1 wherein said rebounding body being provided with a flight stabilizing element.

16. The game and sport equipment of claim 15 wherein said rebounding body being provided with a tail.

17. The game and sport equipment of claim 1 wherein said holder being a bar provided with another handle.

18. The game and sport equipment of claim 17 wherein said bar being hollow and the pull cord being guided through said bar.

19. The game and sport equipment of claim 1 further comprising a counter for counting the swinging movements of said rebounding body.

* * * * *